US010006627B2

(12) United States Patent
Grant

(10) Patent No.: US 10,006,627 B2
(45) Date of Patent: Jun. 26, 2018

(54) DUAL FUEL BOILER

(75) Inventor: Stephen William John Grant, County Offaly (IE)

(73) Assignee: Stephen William John Grant, County Offaly (IE)

( * ) Notice: Subject to any disclaimer, the term of this patent is extended or adjusted under 35 U.S.C. 154(b) by 844 days.

(21) Appl. No.: 13/141,788

(22) PCT Filed: Dec. 23, 2009

(86) PCT No.: PCT/EP2009/067898
§ 371 (c)(1),
(2), (4) Date: Sep. 14, 2011

(87) PCT Pub. No.: WO2010/072830
PCT Pub. Date: Jul. 1, 2010

(65) Prior Publication Data

US 2011/0315092 A1 Dec. 29, 2011

(30) Foreign Application Priority Data

Dec. 23, 2008 (IE) ..... S2008/1023

(51) Int. Cl.
*F22B 31/04* (2006.01)
*F23C 1/02* (2006.01)
(Continued)

(52) U.S. Cl.
CPC ..... *F23C 1/02* (2013.01); *F23C 1/04* (2013.01); *F23C 5/02* (2013.01); *F23D 11/02* (2013.01);
(Continued)

(58) Field of Classification Search
CPC ..... F23C 1/02; F23C 1/04; F23C 1/12; F23C 5/02; F23C 5/06; F23D 17/00; F23D 17/002; F23D 17/004; F23D 17/007
(Continued)

(56) References Cited

U.S. PATENT DOCUMENTS 3,314,604 A * 4/1967 Branson ..... 236/80 R
3,756,201 A * 9/1973 Williams ..... 122/2
(Continued)

FOREIGN PATENT DOCUMENTS

CH 380919 A 8/1964
DE 1297799 B 6/1969
(Continued)

OTHER PUBLICATIONS

FR2576395A1—machine translation.*
International Search Report, dated Apr. 29, 2010, from related International Patent Application No. PCT/EP2009/067898, 5 pgs.

*Primary Examiner* — Nathaniel Herzfeld
(74) *Attorney, Agent, or Firm* — Brian J Colandreo; Michael T. Abramson; Holland & Knight LLP

(57) ABSTRACT

A dual fuel boiler has a granular fuel burner and a fluid fuel burner. The fluid fuel burner is movable between a retracted stored position at a side of a combustion chamber-of the boiler and an extended operative position in which it extends out over a brazier of the granular fuel burner. Thus in the operative position substantially all of the flame and hot combustion gases generated by the fluid fuel burner in use are directed away from the brazier to prevent damage to the brazier.

14 Claims, 4 Drawing Sheets

(51) Int. Cl.

| | |
|---|---|
| ***F23C 1/04*** | (2006.01) |
| ***F23C 5/02*** | (2006.01) |
| ***F23D 11/02*** | (2006.01) |
| ***F23D 14/20*** | (2006.01) |

(52) U.S. Cl.
CPC ..... *F23D 14/20* (2013.01); *F23K 2203/201* (2013.01)

(58) Field of Classification Search
USPC ..... 122/22, 16.1, 211; 110/260, 261, 262; 126/116
See application file for complete search history.

(56) References Cited

U.S. PATENT DOCUMENTS

| | | | | | |
|---|---|---|---|---|---|
| 4,020,822 | A | * | 5/1977 | Harris | 126/110 R |
| 4,162,686 | A | * | 7/1979 | Infield et al. | 122/149 |
| 4,296,711 | A | * | 10/1981 | Bilberg | 122/22 |
| 4,367,697 | A | * | 1/1983 | Ackerman | 122/2 |
| 4,393,814 | A | * | 7/1983 | Sievert | 122/22 |
| 4,450,779 | A | * | 5/1984 | Bailey | 111/52 |
| 4,600,390 | A | * | 7/1986 | Gobel et al. | 433/218 |
| 5,882,184 | A | * | 4/1999 | Feldermann | 431/9 |

FOREIGN PATENT DOCUMENTS

| | | | | | |
|---|---|---|---|---|---|
| FR | 1274230 | A | | 10/1961 | |
| FR | 2576395 | A1 | * | 7/1986 | F23B 3/00 |
| GB | 966236 | A | * | 8/1964 | F23G 5/0273 |
| GB | 1231684 | A | * | 5/1971 | |
| GB | 1231684 | A | | 5/1971 | |
| GB | 2446954 | A | * | 8/2008 | |
| WO | 2008068587 | A2 | | 6/2008 | |

* cited by examiner

DUAL FUEL BOILER

RELATED APPLICATIONS

The subject application is a U.S. National Stage Application of International Application No. PCT/EP2009/067898, filed on 23 Dec. 2009, which claims the priority of Irish Patent Application No.: S2008/1023, filed on 23 Dec. 2008, the contents of which are herein incorporated by reference in its entirety.

INTRODUCTION

The present invention relates to a boiler dual fuel burner assembly.

The invention particularly relates to a boiler dual fuel burner assembly of the type comprising a granular fuel burner, a fluid fuel burner and an air supply duct and associated fan for feeding a granular fuel burner and associated granular fuel brazier and the fluid fuel burner. Such boilers are generally enclosed water heating boilers comprising walls forming a combustion chamber enclosure, hollow heat exchangers arranged for carrying water to be heated, usually provided by at least portion of the walls of the combustion chamber which are hollow water-containing walls. Generally, there is a granular fuel burner and associated granular fuel brazier. The burner is usually some form of electrode but many other types of burner may be used. Generally, they are used to heat the air which then causes the granular fuel to ignite. The fluid fuel burner is, for example, a conventional gas or oil fired burner.

In this specification, the term "granular fuel" is used to include not only granular fuel such as wood pellet formed from wood sawdust, but also other solid materials such as ground or semi-shredded husks of maize and similar products, together with particles of combustible waste material and other recognised fuels such as coal, peat and similar materials.

As stated above, in many such boiler constructions, the granular fuel is contained on a brazier and an electric element is used to heat the granular fuel. The granular fuel in these boilers is very often wood pellets. After a certain amount of time, the wood, or other granular fuel, spontaneously ignites.

Problems do arise with the braziers, for example, there is described a unique construction of brazier in our co-pending European Patent Application No. 08169363.2, filed on Nov. 18, 2008, the disclosure of which is incorporated herein by direct reference. There are, however, certain problems with granular fuel, if only the problem of the need to have a sufficient supply of the fuel. Unfortunately, sometimes the fuel gets damaged due to moisture, when it very often becomes unusable, particularly if the granular fuel being used is wood pellets which are essentially compressed sawdust, without any binder, such that when they get wet, they become useless. There is therefore a need for a standby burner assembly for the boiler, which standby burner assembly is fluid fired, whether liquid or gaseous.

Unfortunately, there are problems in providing these standby burner assemblies. Where the fluid fired boiler is mounted at the entrance to the boiler, side-by-side with the brazier the temperature of ignition of the fluid fired burner is such that the brazier tends to get damaged by the hot flame and combustion gases. While obviously one could avoid this problem by mounting the two burners far apart, this is essentially impractical in most constructions of boiler and further, as well as being impractical, causes considerable mounting problems.

It is known to provide dual fuel burner assemblies for boilers comprising a granular fuel burner and a fluid fuel burner, usually an oil fired burner, however, these are used more to provide ignition for the granular fuel than as purely a stand-by fuel assembly. For example, in PCT Publication No. WO 2008\068587 (Ecoflam Bruciatori S.P.A.) there is described such a dual fuel boiler where the fluid fired burner is used to ignite the granular fuel. It is also known to have a similar construction to that of the afore referenced boiler for backup. However, the problem with these dual fuel burner assemblies is that, for example, with an oil burner, the combustion gases are of the order of 1100° C. and 1200° C., which is extremely hot. This unfortunately causes damage to the surrounding metal and particularly to the brazier. Essentially, then the braziers are destroyed if such an assembly is used for providing back-up heat when granular fuel is unavailable.

The present invention is directed towards providing a boiler dual fuel burner which overcomes these problems and which will be such as to be easily fitted into a boiler shell and not one that will cause damage to, for example, the brazier used in the combustion of the granular fuel.

SUMMARY OF THE INVENTION

The present invention is characterised in that the fluid fuel burner is movable into an operative position within the combustion chamber in which substantially all of the flame and combustion gases generated by the fluid fuel burner in use are directed away from the brazier. Thus advantageously the brazier is protected and is not damaged by operation of the fluid fuel burner.

In one embodiment of the invention the fluid fuel burner is movable between a retracted stored position and an extended operative position.

In another embodiment of the invention the fluid fuel burner locates at a side of the combustion chamber when in the stored position.

In another embodiment of the invention the fluid fuel burner locates outside the combustion chamber when in the stored position.

In a further embodiment of the invention the fluid fuel burner projects into the combustion chamber when in the operative position.

In another embodiment of the invention the fluid fuel burner extends out over the brazier when in the operative position.

In another embodiment of the invention the fluid fuel burner is slidably movable between the stored position and the operative position.

In another embodiment of the invention an actuator is connected to the fluid fuel burner, said actuator being operable for moving the fluid fuel burner between the stored position and the operative position.

Conveniently the actuator comprises a rack attached to the fluid fuel burner and an associated drive pinion which operably engages the rack and a drive motor driveably connected to the pinion.

In another embodiment of the invention the fluid fuel burner is mounted on a telescopic support for movement between the stored position and the operative position.

In another embodiment of the invention the telescopic support comprises a blast tube slidably mounted within an outer support tube, the blast tube being movable through said outer support tube by means of the actuator which is connected to the blast tube, a fluid fuel burner nozzle being mounted at an outer end of the blast tube.

In another embodiment of the invention the blast tube forms an air duct for delivery of combustion air to the nozzle.

In another embodiment of the invention the blast tube has at least one air inlet opening which communicates with the air supply duct when the blast tube is in an extended operative position corresponding to the operative position of the burner.

In another embodiment of the invention air duct has an outlet communicating with the brazier, a valve mounted at the outlet and being operable to close the outlet when the fluid fuel burner is in the operative position.

In another embodiment of the invention the valve is biased into an open position and is movable against said bias into a closed position by means of a ram.

In another embodiment of the invention the ram is operably connected to the fluid fuel supply for the fluid fuel burner such that pressurisation of the fluid fuel for delivery to the fluid fuel burner operates the ram to close the valve.

In another embodiment the valve is mounted on the blast tube such that the valve is closed when the blast tube is in the extended operative position and the valve is open when the blast tube is in the retracted position.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF PREFERRED EMBODIMENTS

Figure 1:
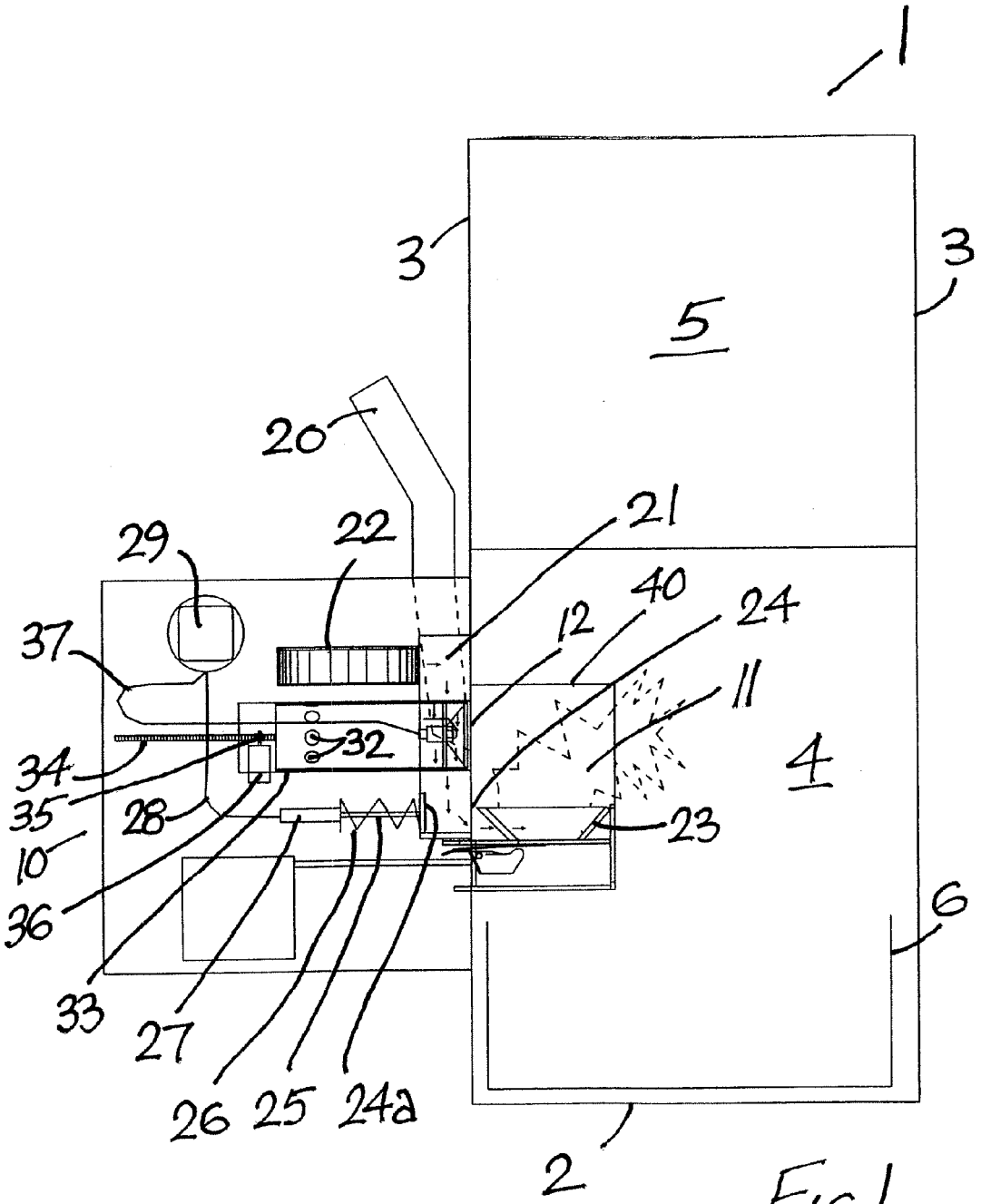
FIG. 1 is a side diagrammatic view of a boiler incorporating a dual fuel burner assembly according to the invention, in a position in which granular fuel is being burned.
Figure 2:
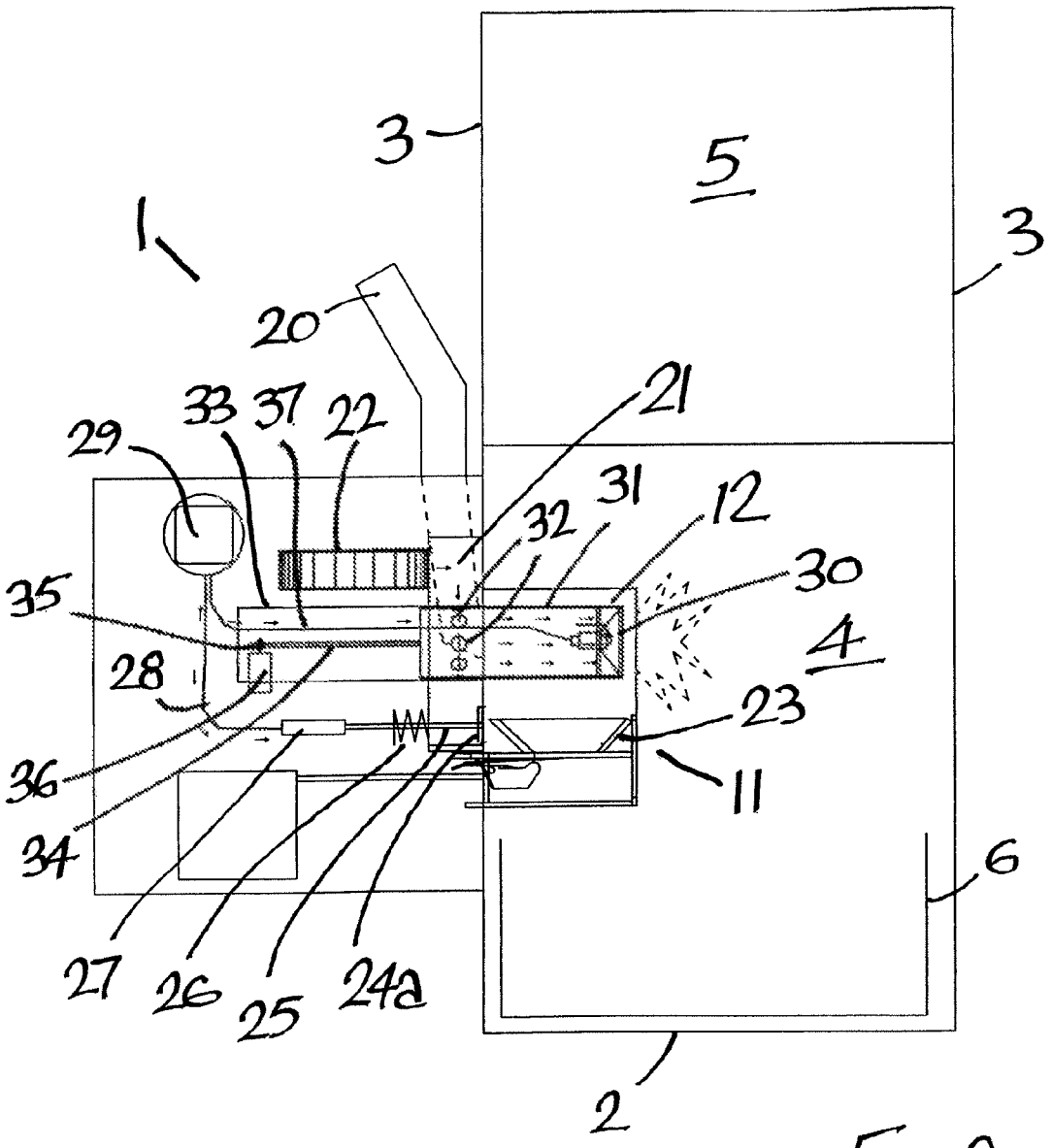
FIG. 2 is a view similar to FIG. 1, in which a fluid fuel burner is being used.

Referring to the drawings, and initially to FIGS. 1 and 2 thereof there is provided a dual fuel boiler, indicated generally by the reference numeral 1, comprising a base 2 and upstanding side walls 3. The boiler 1 is divided into a combustion chamber 4 and a heat transfer and condensing unit 5, containing conventional boiler tubes and, for example, including water-filled walls. Mounted on the base 2 is an ash pan 6. All of this is conventional.

There is further provided a dual fuel burner assembly, indicated generally by the reference numeral 10, comprising a granular fuel burner indicated generally by the reference numeral 11, and a fluid fuel burner, indicated generally by the reference numeral 12, and more clearly illustrated in FIG. 2. The whole of the granular fuel burner 11 is not, strictly speaking illustrated fully as the electrodes are mounted behind the fluid fuel burner 12 in an air chamber which will be described hereinafter.

A wood pellet supply duct 20 feeds an air chamber 21 which in turn is fed by a fan 22. The air chamber 21 is connected to a brazier 23 through an outlet 24 having an associated valve 24*a*. The side valve 24*a* is connected by a con rod 25 and return spring 26 to a hydraulic ram 27 fed by oil through an oil line 28 from a combined motor and oil pump 29. The construction of brazier 23 is described in more detail in our co-pending European Patent Application No. 08169363.2 previously referenced.

The fluid fuel burner, in this embodiment an oil burner 12, comprises an injector nozzle 30 mounted in a blast tube 31. The blast tube 31 includes air supply openings 32 and is in turn mounted in a support tube 33. The support tube 33 further houses a rack 34 and pinion 35 driven by a motor 36. A flexible oil supply line 37 feeds, from the combined motor and oil pump 29, fuel to the injector nozzle 30. The motor 36 is operable to drive the pinion 35 which in turn drives the rack 34 for sliding the blast tube 31 within the support tube 33. Thus, the fluid fuel burner 12 can be moved between a retracted stored position as shown in FIG. 1 and an extended operative position as shown in FIG. 2. As can be seen in the drawings, when in the retracted stored position, the fluid fuel burner 12 locates at a side of the combustion chamber 4 outside the combustion chamber 4 and when in the extended operative position, the fluid fuel burner 12 projects into the combustion chamber 4, extending out over the brazier 23. The rack 34, pinion 35 and motor 36 together form an actuator for slidably moving the fluid fuel burner 12 between the stored position and the operative position.

The blast tube 31 and associated support tube 33 together form a telescopic support for the fluid fuel burner 12. It will be noted that when the blast tube 31 is in the extended position as shown in FIG. 2 a number of circumferentially spaced-apart air supply openings 32 in a side wall of the blast tube 31 communicate with the air chamber 21 for supply of combustion air through the blast tube 31 to the injector nozzle 30. Similar openings may be provided in the support tube 33 for through-passage of air, or alternatively the air supply openings 32 may be positioned outwardly of an outer end of the support tube 33 when the blast tube 31 is in the fully extended position.

As the oil pump 29 is switched on to supply pressurised fuel to the injector nozzle 30, pressurised oil is delivered through the oil line 28 to the ram 27 which overcomes spring 26 bias to close the valve 24*a* cutting off air supply to the brazier 23.

Finally, it will be noted that above the brazier 23, there is mounted a canopy 40, which canopy 40 is to make sure the combustion in the brazier 23 is full combustion and that there is not residual carbon monoxide (CO) in the boiler to be subsequently exhausted to atmosphere.

In operation, and referring firstly to FIG. 1 where the boiler 1 is shown in operation as a wood pelletted boiler, namely, with the granular fuel burner 11 in operation, wood pellets are delivered through the wood pellet supply duct 20 into the brazier 23 in conventional manner. Simultaneously, air is delivered by the fan 22 into the air chamber 21 and through the outlet 24, the valve 24*a* of which is now open, and into the brazier 23 for normal combustion. The air in the air chamber 21 bypasses the support tube 33 and blast tube 31.

In operation, when it is desired to use the fluid fuel burner, in this case, the oil burner 12, the motor 36 is operated and the blast tube 31 is extended from a retracted stored position within the support tube 33. The air supply openings 32 in the blast tube 31 are exposed and air is delivered from the air chamber 21 through the blast tube 31 to the burner 12 injector nozzle 30. The valve 24*a* is shut by the hydraulic ram 27 closing the outlet 24 to the brazier 23.

It will be noted that now the combustion flame and gases generated by the injector nozzle 30 are injected into the combustion chamber 4 remote from the brazier 23 and are directed away from the brazier 23.

Figure 3:
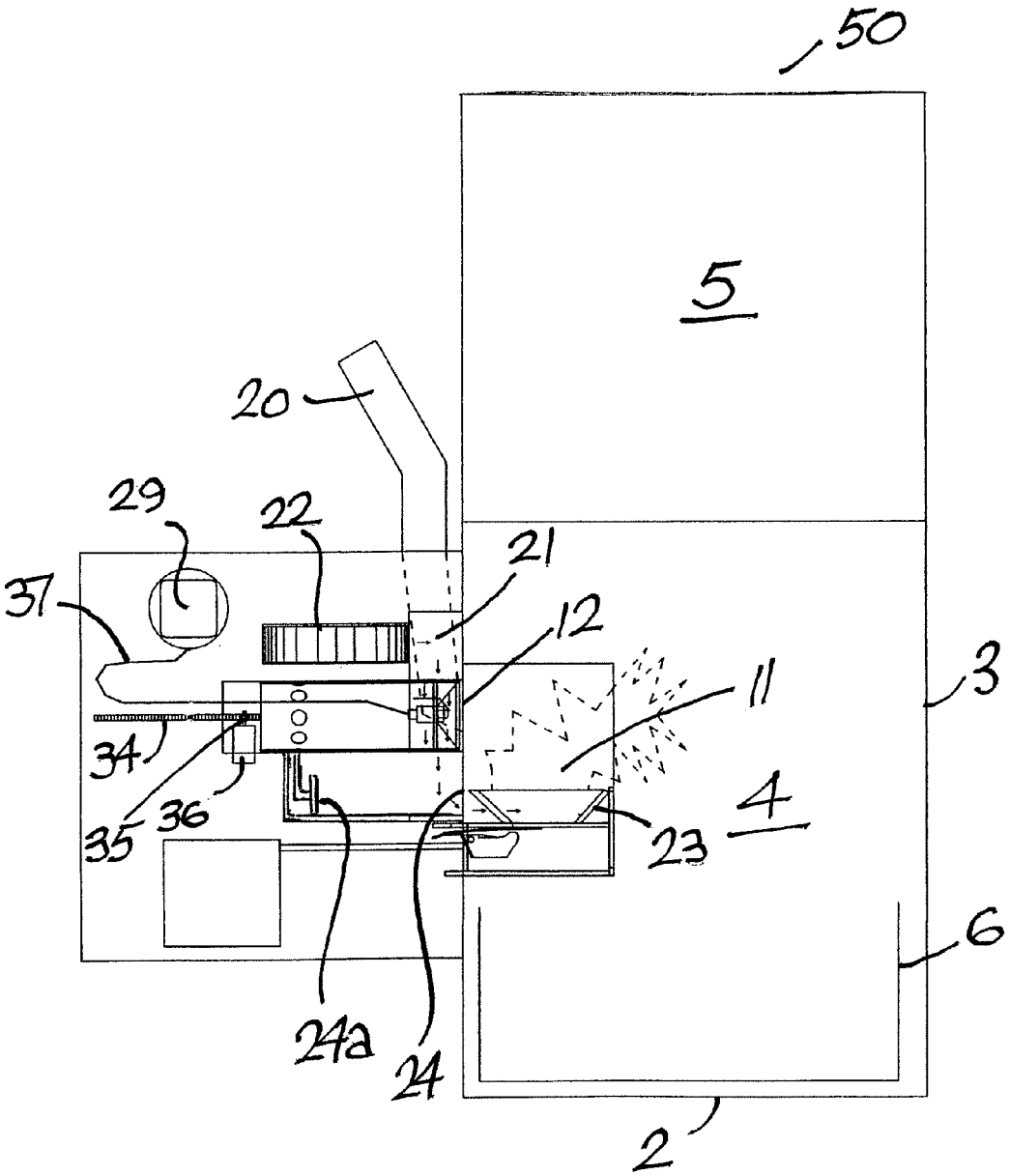
FIG. 3 is a view similar to FIG. 1 showing another boiler according to a second embodiment of the invention.
Figure 4:
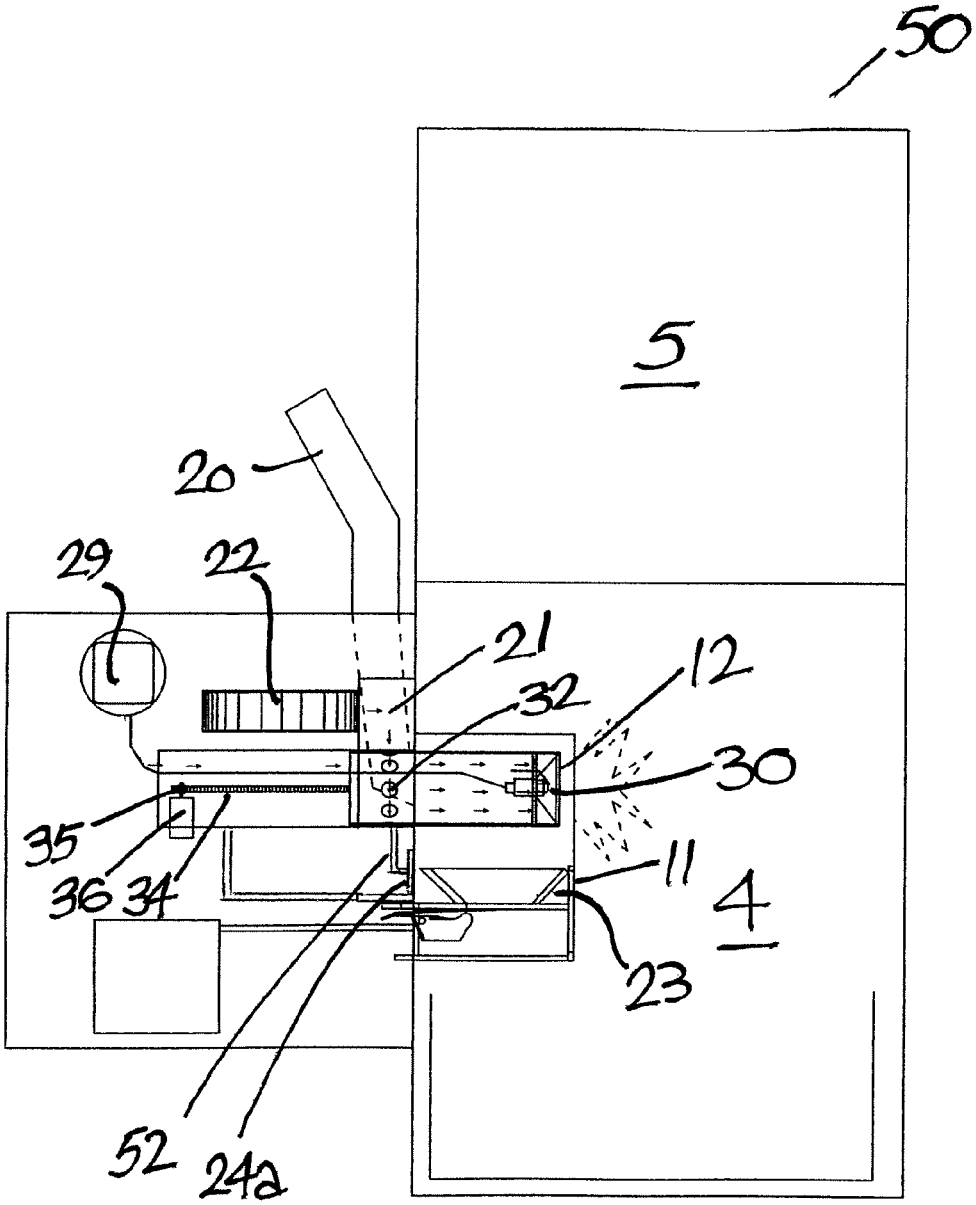
FIG. 4 is a view similar to FIG. 2 of the boiler of FIG. 3.

Referring now to FIGS. 3 and 4, there is illustrated another duel fuel boiler indicated generally by the reference numeral 50. It is largely similar to the boiler 1 described previously and like parts are assigned the same reference numerals. In this case the valve 24*a* is mounted by an arm 52 on the blast tube 31 such that the valve 24*a* is closed when the blast tube 31 is in the extended operative position shown in FIG. 4 and the valve 24*a* is open when the blast tube 31 is in the retracted position shown in FIG. 3. A suitable opening is provided in the support tube 33 for through-passage of the arm 52. Other than this the construction and operation of the boiler 50 is similar to that for the boiler 1 described previously.

In this specification, the terms "comprise", "comprises", "comprised" and "comprising" and the terms "include", "includes", "included" and "including" are deemed totally interchangeable and should be afforded the widest possible interpretation.

The invention is in not limited to the embodiments hereinbefore described but may be varied in both construction and detail, within the scope of the appended claims.

The invention claimed is:

1. A dual fuel burner assembly for a boiler having a combustion chamber, comprising:

a granular fuel burner mounted on a side wall of the combustion chamber;

a granular fuel brazier associated with the granular fuel burner, said granular fuel brazier being mounted on the side wall of the combustion chamber and projecting outwardly therefrom into the combustion chamber;

a canopy mounted within the combustion chamber above the granular fuel brazier to promote full combustion of granular fuel in the granular fuel brazier;

a fluid fuel burner mounted above the granular fuel brazier on the same side wall of the combustion chamber as the granular fuel brazier;

an air supply duct and associated fan for feeding the granular fuel burner and associated granular fuel brazier and the fluid fuel burner;

wherein the fluid fuel burner is mounted adjacent the granular fuel brazier on the side wall of the combustion chamber with the fluid fuel burner mounted above the granular fuel brazier between the granular fuel brazier and the associated canopy, and the fluid fuel burner is movable within the combustion chamber between a retracted stored position on the side wall of the combustion chamber at a side of the combustion chamber and an extended operative position in which the fluid fuel burner projects outwardly from the side wall of the combustion chamber into the combustion chamber extending out over the granular fuel brazier in which flame and combustion gases generated by the fluid fuel burner in use when it is in the extended operative position are directed away from the granular fuel brazier.

2. The dual fuel burner assembly as claimed in claim 1 wherein the fluid fuel burner locates outside the combustion chamber when in the stored position.

3. The dual fuel burner assembly as claimed in claim 1 wherein the fluid fuel burner is slidably movable between the stored position and the operative position.

4. The duel fuel burner assembly as claimed in claim 1 wherein an actuator is connected to the fluid fuel burner, said actuator being operable for moving the fluid fuel burner between the stored position and the operative position.

5. The duel fuel burner assembly as claimed in claim 4 wherein the actuator comprises a rack attached to the fluid fuel burner and an associated drive pinion which operably engages the rack and a drive motor driveably connected to the pinion.

6. The dual fuel burner assembly as claimed in claim 1 wherein the fluid fuel burner is mounted on a telescopic support for movement between the stored position and the operative position.

7. The dual fuel burner assembly as claimed in claim 6 wherein an actuator is connected to the fluid fuel burner, said actuator being operable for moving the fluid fuel burner between the stored position and the operative position, and the telescopic support comprises a blast tube slidably mounted within an outer support tube, the blast tube being movable through said outer support tube by means of the actuator which is connected to the blast tube, a fluid fuel burner nozzle being mounted at an outer end of the blast tube.

8. The dual fuel burner assembly as claimed in claim 7 wherein the blast tube forms an air duct for delivery of combustion air to the nozzle.

9. The dual fuel burner assembly as claimed in claim 8 wherein the blast tube has at least one air inlet opening which communicates with the air supply duct when the blast tube is in an extended operative position corresponding to the operative position of the burner.

10. The dual fuel burner assembly as claimed in claim 1 wherein the air duct has an outlet communicating with the brazier, a valve mounted at the outlet and being operable to close the outlet when the fluid fuel burner is in the operative position.

11. The dual fuel burner assembly as claimed in claim 10 wherein the valve is biased into an open position and is movable against said bias into a closed position by means of a ram.

12. The dual fuel burner assembly as claimed in claim 11 wherein the ram is operably connected to the fluid fuel supply for the fluid fuel burner such that pressurisation of the fluid fuel for delivery to the fluid fuel burner operates the ram to close the valve.

13. The dual fuel burner assembly as claimed in claim 10 wherein the fluid fuel burner is mounted on a telescopic support for movement between the stored position and the operative position, an actuator is connected to the fluid fuel burner, said actuator being operable for moving the fluid fuel burner between the stored position and the operative position, and the telescopic support comprises a blast tube slidably mounted within an outer support tube, the blast tube being movable through said outer support tube by means of the actuator which is connected to the blast tube, a fluid fuel burner nozzle being mounted at an outer end of the blast tube, wherein the valve is mounted on the blast tube such that the valve is closed when the blast tube is in the extended operative position and the valve is open when the blast tube is in the retracted position.

14. A dual fuel burner assembly for a boiler having a combustion chamber, comprising:

a granular fuel burner mounted on a side wall of the combustion chamber;

a granular fuel brazier associated with the granular fuel burner, said granular fuel brazier being mounted on the side wall of the combustion chamber and projecting outwardly therefrom into the combustion chamber;

a canopy mounted within the combustion chamber above the granular fuel brazier to promote full combustion of granular fuel in the granular fuel brazier;

a fluid fuel burner mounted above the granular fuel brazier on the same side wall of the combustion chamber as the granular fuel brazier;

an air supply duct and associated fan for feeding the granular fuel burner and associated granular fuel brazier and the fluid fuel burner;

wherein the fluid fuel burner is mounted adjacent the granular fuel brazier on the side wall of the combustion chamber with the fluid fuel burner mounted above the granular fuel brazier between the granular fuel brazier and the associated canopy, and the fluid fuel burner is slidably movable within the combustion chamber between a retracted stored position on the side wall of the combustion chamber at a side of the combustion chamber and an extended operative position in which the fluid fuel burner projects outwardly from the side wall of the combustion chamber into the combustion chamber extending out over the granular fuel brazier such that flame and combustion gases generated by the fluid fuel burner in use when it is in the extended operative position are directed away from the granular fuel brazier.

* * * * *